US010225908B2

(12) United States Patent
Wei et al.

(10) Patent No.: US 10,225,908 B2
(45) Date of Patent: Mar. 5, 2019

(54) ACTIVE DAMPING CIRCUIT

(71) Applicant: OSRAM SYLVANIA Inc., Wilmington, MA (US)

(72) Inventors: Jinsheng Wei, Brea, CA (US); Andrew Johnsen, Danvers, MA (US); Ranjit Jayabalan, Boxborough, MA (US); Nitin Kumar, Bavaria (DE)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 15/552,241

(22) PCT Filed: Feb. 25, 2016

(86) PCT No.: PCT/US2016/019659
§ 371 (c)(1),
(2) Date: Aug. 18, 2017

(87) PCT Pub. No.: WO2016/138321
PCT Pub. Date: Sep. 1, 2016

(65) Prior Publication Data

US 2018/0098395 A1 Apr. 5, 2018

Related U.S. Application Data

(60) Provisional application No. 62/120,646, filed on Feb. 25, 2015.

(51) Int. Cl.
*H05B 37/02* (2006.01)
*H05B 33/08* (2006.01)

(52) U.S. Cl.
CPC ..... *H05B 37/0209* (2013.01); *H05B 33/0815* (2013.01); *H05B 33/0842* (2013.01)

(58) Field of Classification Search
CPC ..... H05B 33/0815; H05B 33/0842
(Continued)

(56) References Cited

U.S. PATENT DOCUMENTS 8,981,661 B2 * 3/2015 Melanson ..... H05B 33/0815 315/246
9,414,450 B2 * 8/2016 van den Broeke ..... H05B 33/0815
(Continued)

FOREIGN PATENT DOCUMENTS

EP 2 696 486 A2 2/2014
WO 2012/007797 A1 1/2012
(Continued)

OTHER PUBLICATIONS

Muller, Uta, International Search Report and Written Opinion of the International Searching Authority for PCT/US2016/019656, dated May 6, 2016, pp. 1-12, European Patent Office, Rijswijk, The Netherlands.
(Continued)

*Primary Examiner* — Thuy Vinh Tran
(74) *Attorney, Agent, or Firm* — Shaun P. Montana

(57) ABSTRACT

An active damping circuit is disclosed, which includes a peak current limiter, a drain source voltage limiter, a turn-on driver, a resistor shunt circuit, and a peak current sensor. The peak current sensor detects a rising edge of an input voltage from a phase cut dimmer by detecting a higher peak current. This drives a collector voltage of a second transistor of the peak current limiter low, which lowers a gate voltage of a first transistor of the peak current sensor, and forces it into a linear operating region, so it functions as a damping resistor. When the peak current sensor detects a decreased peak current, such that the turn-on edge of the input voltage is passed, the second transistor turns off, and the turn-on driver turns the first transistor on, such that the active
(Continued)

damping circuit is waiting for a next edge of the input voltage.

19 Claims, 7 Drawing Sheets

(58) Field of Classification Search
USPC ..... 315/194, 291
See application file for complete search history.

(56) References Cited

U.S. PATENT DOCUMENTS

2012/0026761 A1 2/2012 Young
2013/0307417 A1 11/2013 Chen et al.
2014/0084801 A1 3/2014 Lys
2014/0300289 A1 10/2014 Zhu
2015/0359053 A1* 12/2015 van den Broeke ..... H05B 33/0815 315/200 R
2016/0218626 A1* 7/2016 Del Carmen, Jr. ..... H05B 33/0815
2017/0181233 A1* 6/2017 van den Broeke ..... H05B 33/0815

FOREIGN PATENT DOCUMENTS

WO 2012/016197 A1 2/2012
WO 2013/072111 A1 5/2013

OTHER PUBLICATIONS

Muller, Uta, International Search Report and Written Opinion of the International Searching Authority for PCT/US2016/019659, dated May 6, 2016, pp. 1-12, European Patent Office, Rijswijk, The Netherlands.

* cited by examiner

ACTIVE DAMPING CIRCUIT

CROSS-REFERENCE TO RELATED APPLICATIONS

The present application is a National Stage application of, and claims the benefit of priority of, International Application No. PCT/US2016/019659, which claims priority of U.S. Provisional Application No. 62/120,646, entitled "ACTIVE DAMPING CIRCUITS" and filed Feb. 25, 2015, the entire contents of which are hereby incorporated by reference.

The present application is related to PCT Application No. PCT/US2016/019656 entitled "ACTIVE DAMPING CIRCUIT", and filed on Feb. 25, 2016, the entire contents of which are hereby incorporated by reference.

TECHNICAL FIELD

The present invention relates to electronics, and more specifically, to active damping circuits.

BACKGROUND

Traditional light sources are typically dimmed using a phase cut dimmer, which includes or is based on a Triode for Alternating Current (TRIAC), for example. Traditional TRIAC-based phase cut dimmers do not function well with solid state light sources. In order to function, a solid state light source typically needs a driver (also referred to as a power supply). These typically include components to decrease electromagnetic interference (EMI), such as inductors or capacitors. Such components can create resonance that disrupts the operation of a traditional TRIAC-based phase cut dimmer. A phase cut or TRIAC-based dimmer requires a minimum holding current after being triggered. If the current drops below this level, or becomes negative for a certain time, the TRIAC dimmer will be turned off and would try to restart. The resonant nature of a typical input EMI filter on a driver, as well as line inductance, can easily lead to the reversal of line current, causing the TRIAC to lose conduction shortly after triggering. This may result in the TRIAC turning on and turning off, repeatedly, during each half line period, introducing flickering into the solid state light source(s) operated by the driver.

SUMMARY

To address flickering potentially introduced by using a conventional TRIAC or phase cut dimmer with a driver for solid state light sources, a damping circuit (also referred to as a damper circuit) is typically used. The damping circuit is inserted between the dimmer and the driver, or integrated into the driver's front EMI filter. The damping circuit then damps the input current to the driver, preventing it from becoming negative. Damping circuits may be passive or active. Passive damping circuits typically include Resistor Capacitor (RC) or Resistor Capacitor Diode (RCD) circuits, which produce higher power losses because they receive power even when the turn-on of the dimmer is complete. Active damping circuits only operate when needed during the turn-on short period of the dimmer.

Conventional active damping circuits, particularly for lighting loads, may offer low costs due to low numbers of components, but suffer from a variety of other deficiencies. For example, such conventional damping circuits frequently have a high power loss, and separate the control logic from the MOSFET's gate-source voltage control logic by line voltage. Such conventional damping circuits also require two line voltage resistor dividers, due to the grounds present in the circuit. Further, conventional active damping circuits generally insert a resistor and a capacitor, temporarily, into a main power circuit and combine with the driver's EMI filter's inductance or line inductance to form a Resistor Inductor Capacitor (RLC) circuit. Adapting the value of the resistor can damp the resonance of the LC portion of the circuit. However, when an input voltage is high, the resonance is likely higher, which means that the chosen damping resistor may work for low input voltages but not high input voltages. This is particularly true for drivers that operate on a so-called universal input voltage of either 120 volts or 277 volts.

Embodiments provide an active damping circuit that uses a current sense resistor to detect the phase edge instantly, or near instantly, and to adjust a switch (e.g., a MOSFET) to limit the peak inrush current and to damp the rings for the input current. Such embodiments include a current sense resistor, a damper switch (e.g., a MOSFET) with a drive circuit, and a low voltage rating switch (e.g., MOSFET) to short the current sense resistor, along with a drive circuit. Such embodiments are capable of operating at both low AC input (e.g., 120V), and at high AC input (e.g., 277V). Such embodiments keep efficiency high, even while using more components than other possible embodiments, and also improve total harmonic distortion, have no input current distortion, and improved efficiency, among other things.

In an embodiment, there is provided an active damping circuit. The active damping circuit includes: a peak current limiter; a drain source voltage limiter; a turn-on driver; a resistor shunt circuit; and a peak current sensor.

In a related embodiment, the peak current sensor may include: a first resistor including a first lead and a second lead, wherein the second lead may be connected to a ground; a first transistor including a gate, a source, and a drain, wherein the source may be connected to the ground; a first diode including a first lead connected to the gate of the first transistor, and a second lead connected to the first lead of the first resistor; and a first capacitor including a first lead connected to the gate of first transistor and a second lead connected to the ground. In a further related embodiment, the peak current limiter may include: a second resistor including a first lead connected to the gate of the first transistor and the first lead of the first diode; a third resistor including a first lead and a second lead, wherein the second lead may be connected to the ground; a fourth resistor including a first lead connected to the first lead of the first resistor and the second lead of the first diode; and a second transistor including a base, a collector, and an emitter, wherein the base may be connected to the second lead of the third resistor, the collector may be connected to the second lead of the second resistor, and the emitter may be connected to the second lead of the fourth resistor. In a further related embodiment, the drain source voltage current limiter may include: a second diode including a first lead and a second lead, wherein the first lead may be connected to the drain of the first transistor; and a fifth resistor including a first lead and a second lead, wherein the first lead may be connected to the first lead of the first diode, the first lead of the second resistor, and the gate of the first transistor, and wherein the second lead may be connected to the second lead of the second diode. In a further related embodiment, the turn-on driver may include: a sixth resistor including a first lead and a second lead, wherein the first lead may be connected to the first lead of the first diode, the first lead of the second resistor, and the gate of the first transistor; and a first voltage source including a first lead and a second lead, wherein the first lead may be connected to the second lead of the sixth resistor and the second lead may be connected to the ground. In a further related embodiment, the active damping circuit may be configured to detect a rising edge of an input voltage from a phase cut dimmer via a rectifier by detecting a higher peak current flowing through the first resistor.

In a further related embodiment, the higher peak current flowing through the first resistor may result in a voltage drop across the first resistor, which through the third resistor may drive a collector voltage of the second transistor low, which may lower a gate voltage of the first transistor, and may force the first transistor into a linear operating region, such that the first transistor functions as a damping resistor. In a further related embodiment, the first resistor and the fourth resistor may be a gain for the turn-on driver, and the second resistor may limit a current of the second transistor. In a further related embodiment, the first resistor, the first capacitor, and the first transistor may form a damper circuit configured to damp rings of an input current and to prevent input current ringing into the negative, which would turn off a phase cut dimmer connected to the active damping circuit. In a further related embodiment, a voltage at the drain of the first transistor may be sensed, and feedback by the second diode and the fifth resistor may limit the drain voltage of the first transistor. In a further related embodiment, the active damping circuit may be configured to detect a passing of the turn-on edge of the input voltage such that a sensed peak current on the first resistor may be decreased, and the second transistor may return to an off state, such that a voltage from the first voltage source may recharge the gate of the first transistor, turning on the first transistor, such that the active damping circuit is waiting for a next edge of the input voltage.

In another related embodiment, the active damping circuit may be configured to operate with an input voltage being between 120 volts and 277 volts, inclusive.

In still another related embodiment, the active damping circuit may be configured to detect a rising edge of an input voltage from a phase cut dimmer via a rectifier by detecting a higher peak current flowing through the peak current sensor. In a further related embodiment, the higher peak current flowing through the peak current sensor may result in a voltage drop across a first resistor of the peak current sensor, which through a third resistor of the peak current limiter may drive a collector voltage of a second transistor of the peak current limiter low, which may lower a gate voltage of a first transistor of the peak current sensor, and may force the first transistor into a linear operating region, such that the first transistor functions as a damping resistor.

In another further related embodiment, the peak current sensor may be configured to as a damper circuit configured to damp rings of an input current and to prevent input current ringing into the negative, which would turn off a phase cut dimmer connected to the active damping circuit. In yet another further related embodiment, a voltage at a drain of a first transistor of the peak current sensor may be sensed, and feedback by the drain source voltage current limiter may be configured to limit the voltage at the drain of the first transistor. In still another further related embodiment, the active damping circuit may be configured to detect a passing of the turn-on edge of the input voltage such that a sensed peak current at the peak current sensor may be decreased, and a second transistor of the peak current limiter may switch to an off state, such that a voltage from the turn on driver may recharge a gate of a first transistor of the peak current sensor, turning on the first transistor, such that the active damping circuit is waiting for a next edge of the input voltage.

In another embodiment, there is provided a system. The system includes: an input voltage source; a phase cut dimmer; a rectifier; a filter circuit; and an active damping circuit, wherein the active damping circuit comprises: a peak current limiter; a drain source voltage limiter; a turn-on driver; a resistor shunt circuit; and a peak current sensor.

In a related embodiment, the peak current sensor may include: a first resistor including a first lead and a second lead, wherein the second lead may be connected to a ground; a first transistor including a gate, a source, and a drain, wherein the source may be connected to the ground; a first diode including a first lead connected to the gate of the first transistor, and a second lead connected to the first lead of the first resistor; and a first capacitor including a first lead connected to the gate of first transistor and a second lead connected to the ground; and wherein the filter circuit may include: a second capacitor including a first lead connected to the drain of the first transistor and a second lead; a first inductor including a first lead connected to the second lead of the second capacitor and a second lead configured to receive a rectified voltage from the rectifier; a third diode including a first lead and a second lead, wherein the first lead may be connected to the first lead of the first inductor; and a fourth diode including a first lead connected to the second lead of the third diode and a second lead connected to the second lead of the first inductor.

In a further related embodiment, the first resistor, the first capacitor, and the first transistor may form a damper circuit that, in combination with the inductance of the filter circuit, damp rings of the input current and prevents the input current ringing into the negative, which would turn off the phase cut dimmer.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
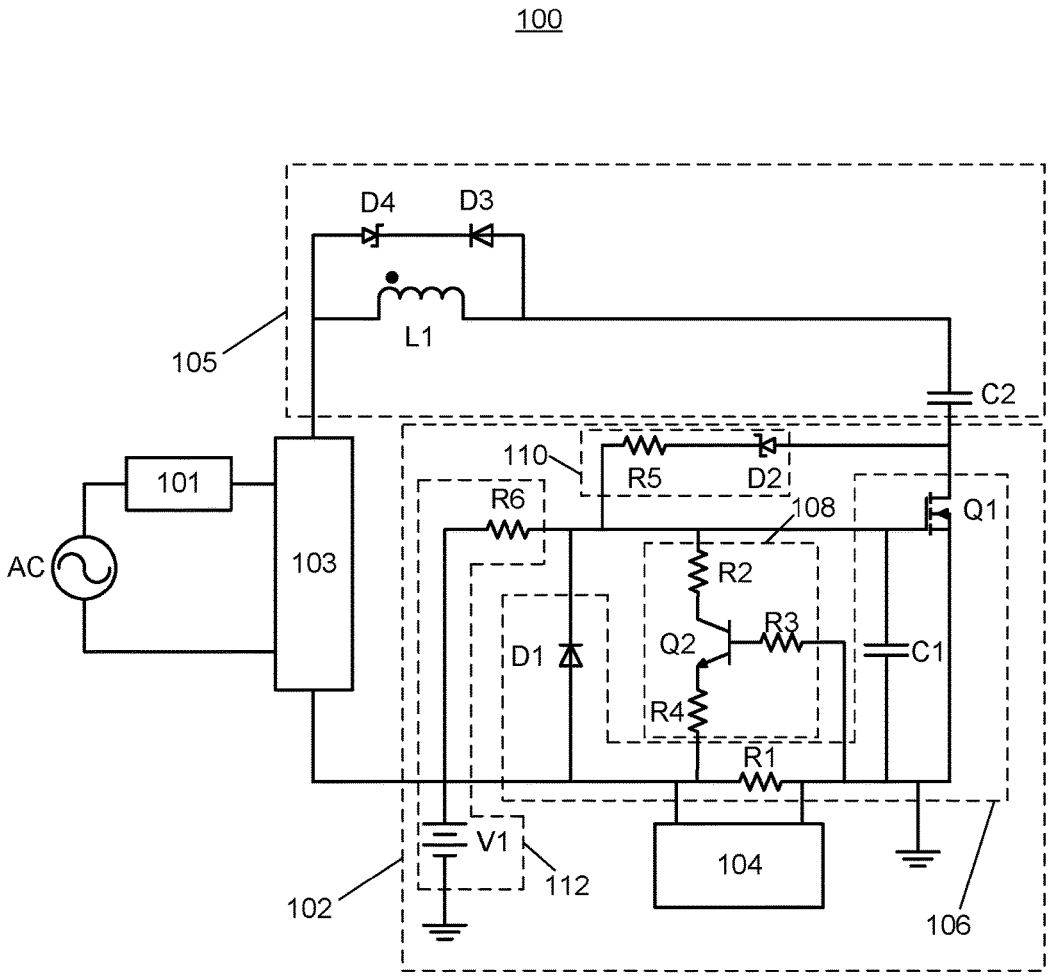
FIG. 1 shows an active damping circuit for a universal input voltage dimmer, according to embodiments disclosed herein.

FIG. 1 shows a system 100 including an input voltage source AC, a phase cut dimmer 101, a rectifier 103, a filter circuit 105, and an active damping circuit 102. The input voltage source AC is connected to the phase cut dimmer 101 and to the rectifier 103. The phase cut dimmer 101 is also connected to the rectifier 103. The filter circuit is connected to the rectifier 103 and to the active damping circuit 102. The rectifier is also connected to the active damping circuit 102.

The active damping circuit 102 includes a resistor shunt circuit 104, a peak current sensor 106, a peak current limiter 108, a drain source voltage limiter 110, and a turn-on driver 112. The peak current sensor 106 includes a first resistor R1 having a first lead and a second lead, where the first lead is connected to the rectifier 103 and the second lead is connected to a ground. The peak current sensor 106 also includes a first transistor Q1. The first transistor Q1, which in some embodiments is an n-channel MOSFET, includes a gate, a source, and a drain. The source is connected to the ground. The drain is connected to the filter circuit 105. The peak current sensor 106 also includes a first diode D1. The first diode D1 has a first lead connected to the gate of the first transistor Q1, and has a second lead connected to the first lead of the first resistor R1. The peak current sensor also includes a first capacitor C1, which has a first lead connected to the gate of first transistor Q1 and has a second lead connected to the ground.

The peak current limiter 108 includes a second resistor R2, a third resistor R3, a fourth resistor R4, and a second transistor Q2. In some embodiments, the second transistor Q2 is a bipolar junction transistor. The second resistor R2 has a first lead connected to the gate of the first transistor Q1 and the first lead of the first diode D1. The second resistor R2 is also connected to a collector of the second transistor Q2. The third resistor R3 has a first lead connected to the ground and a second lead connected to a base of the second transistor Q2. The fourth resistor R4 has a first lead connected to the first lead of the first resistor R1 and the second lead of the first diode D1, and a second lead connected to an emitter of the second transistor Q2.

The drain source voltage current limiter 110 includes a second diode D2 and a fifth resistor R4. The second diode D2 has a first lead connected to the drain of the first transistor Q1 and a second lead connected to the fifth resistor R5. The fifth resistor R5 has a first lead connected to the first lead of the first diode D1, the first lead of the second resistor R2, and the gate of the first transistor Q1. The fifth resistor R5 also has a second lead connected to the second lead of the second diode D2.

The turn-on driver 112 includes a sixth resistor R6 and a first voltage source V1. The sixth resistor R6 has a first lead connected to the first lead of the first diode D1, the first lead of the second resistor R2, the gate of the first transistor Q1, and the first lead of the fifth resistor R5. The sixth resistor R6 also has a second lead, which is connected to the first voltage source V1 and to the first lead of the first resistor R1. The first voltage source V1 is also connected to ground.

The resistor shunt circuit 104 is connected in parallel across the first resistor R1. The resistor shunt circuit 104 includes any component or arrangement of components that will shunt current and/or voltage around the first resistor R1.

The filter circuit 105, in some embodiments, includes a second capacitor C2, a first inductor L1, a third diode D3, and a fourth diode D4. The second capacitor C2 has a first lead connected to the drain of the first transistor Q1 and a second lead connected to the first inductor L1. The first inductor L1 has a first lead connected to the second lead of the second capacitor C2 and a second lead connected to the rectifier 103. The third diode has a first lead connected to the first lead of the first inductor, and a second lead connected to the fourth diode. The fourth diode has a first lead connected to the second lead of the third diode and a second lead connected to the second lead of the first inductor.

The active damping circuit 102 is turned on and off by sensing a peak current of an input voltage from the input voltage source AC, the phase cut dimmer 101, and the rectifier 103. More specifically, when the phase cut dimmer 101 turns on, the rising edge of the input voltage from the rectifier 103 is detected by a higher peak current flowing through the first resistor R1. This sensed higher peak current produces a voltage increase across the first resistor R1, which through the fourth resistor R4, drives the collector voltage of the second transistor Q2 low. This lowers the gate voltage of the first transistor Q1, and forces the first transistor Q1 into the linear operating region, such that the first transistor Q1 acts as a damping resistor. During this time period, the first resistor R1, the first capacitor C1, and the first transistor Q1 (which is acting like a damping resistor) form a damper circuit, which in some embodiments includes the inductance of the filter circuit 105, to damp the rings of the input current and to prevent input current ringing into the negative, which would turn off the phase cut dimmer 101, particularly if the phase cut dimmer 101 includes a TRIAC. At the same time, the voltage at the drain of the first transistor Q1 is sensed and feedback by the second diode D2 and the fifth resistor R5 limit that drain voltage for protection. After passing the turn-on edge of input voltage from the phase cut dimmer 102, the sensed peak current on the first resistor R1 would be decreased, and then the second transistor Q2 is back to its off state, such that the voltage of the first voltage source V1 recharges the gate of the first transistor Q1, turning on the first transistor Q1, and configuring the active damping circuit 102 to wait for the next edge of the input voltage from the phase cut dimmer 101.

Figure 2A:
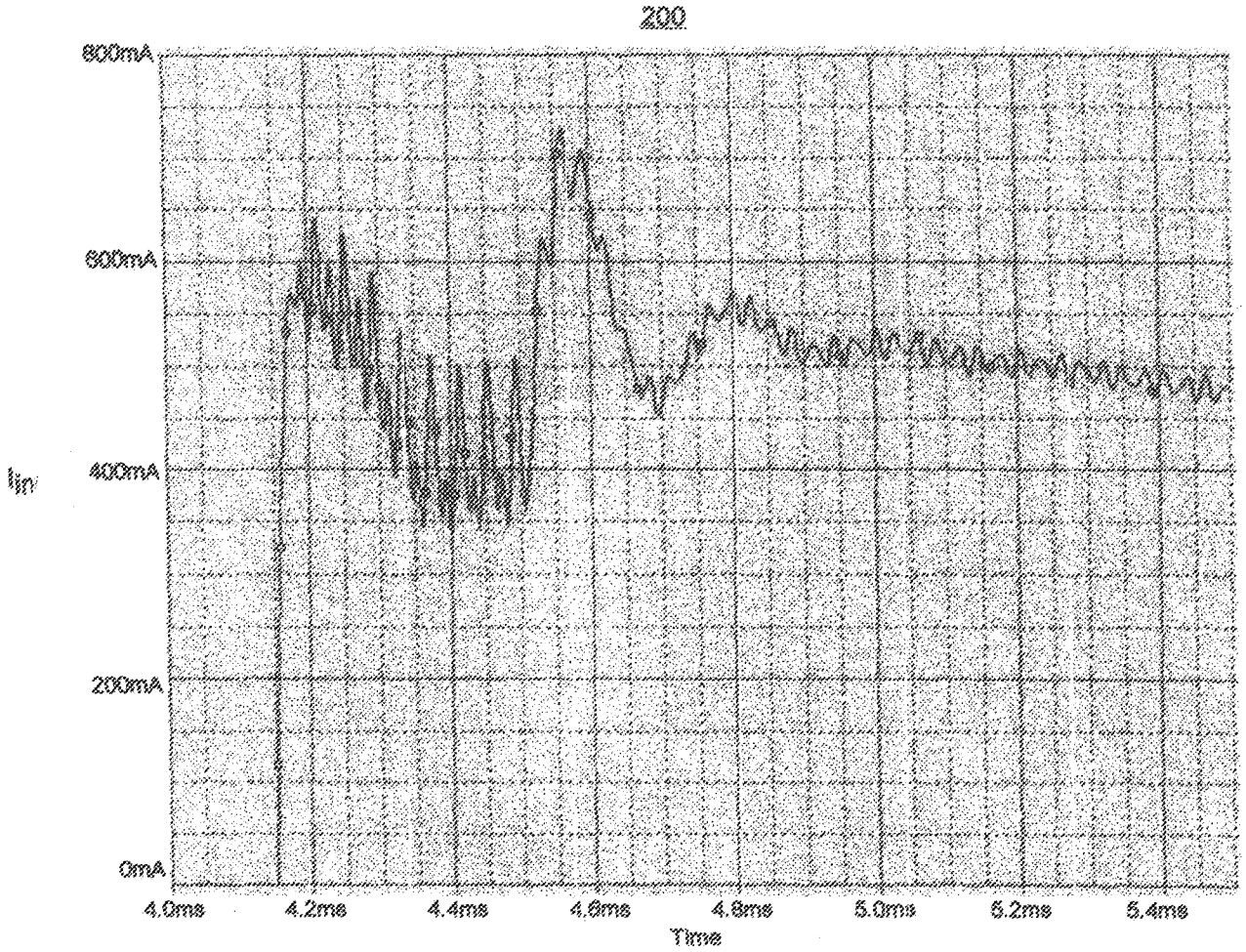
FIG. 2A shows a graph of simulation results for the active damping circuit of FIG. 1 when the input voltage is 120V at half load.
Figure 2B:
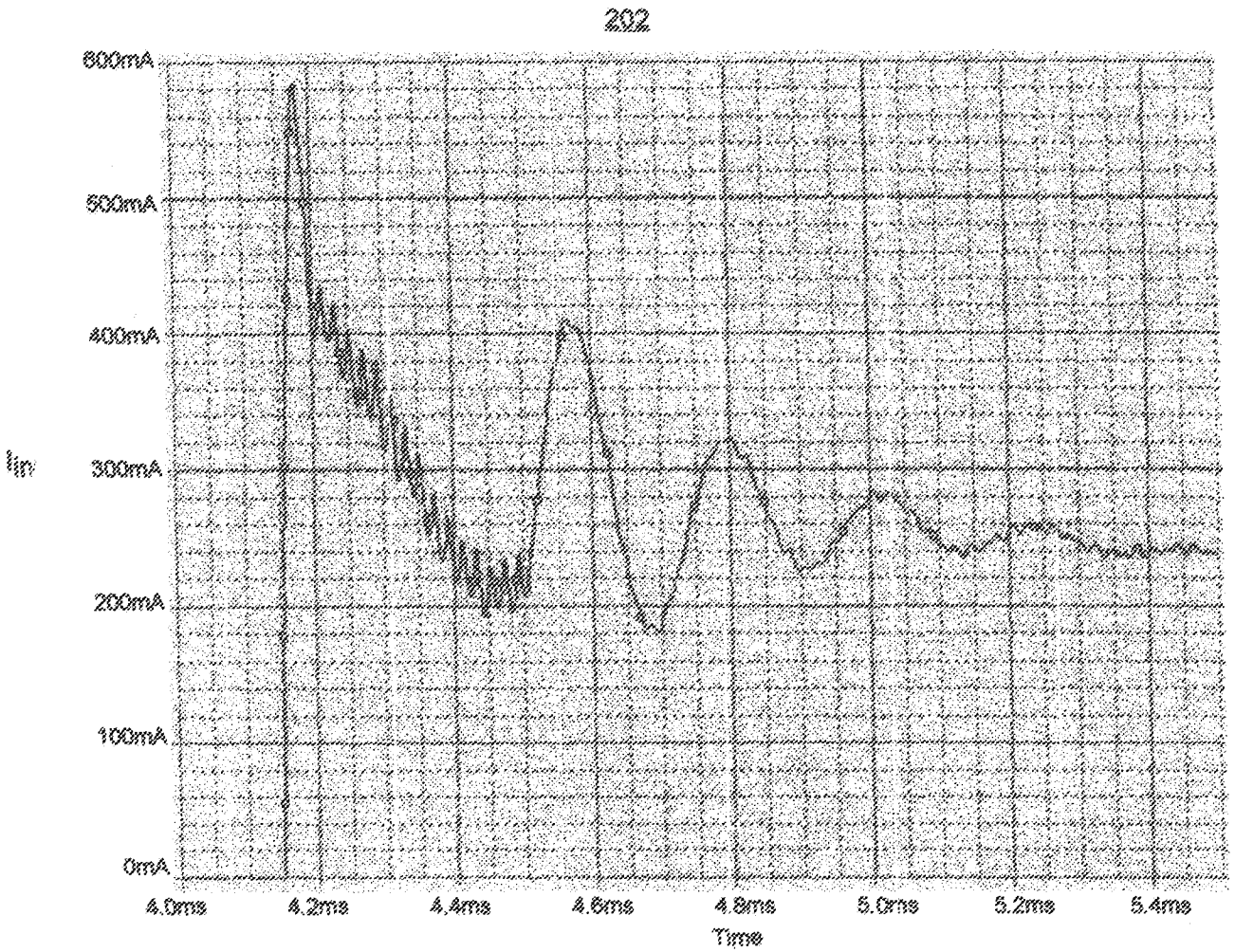
FIG. 2B shows a graph of simulation results for the active damping circuit of FIG. 1 when the input voltage is 120V at full load.
Figure 2C:
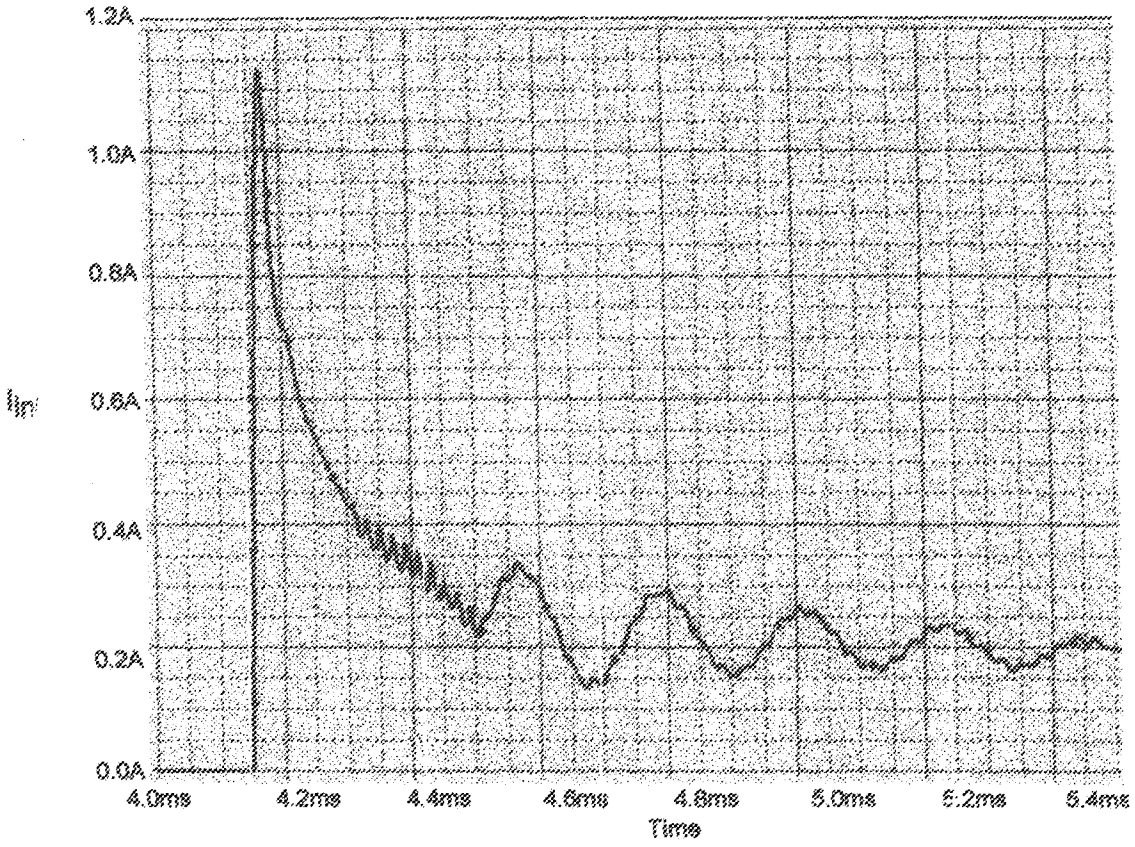
FIG. 2C shows a graph of simulation results for the active damping circuit of FIG. 1 when the input voltage is 277V at full load.
Figure 2D:
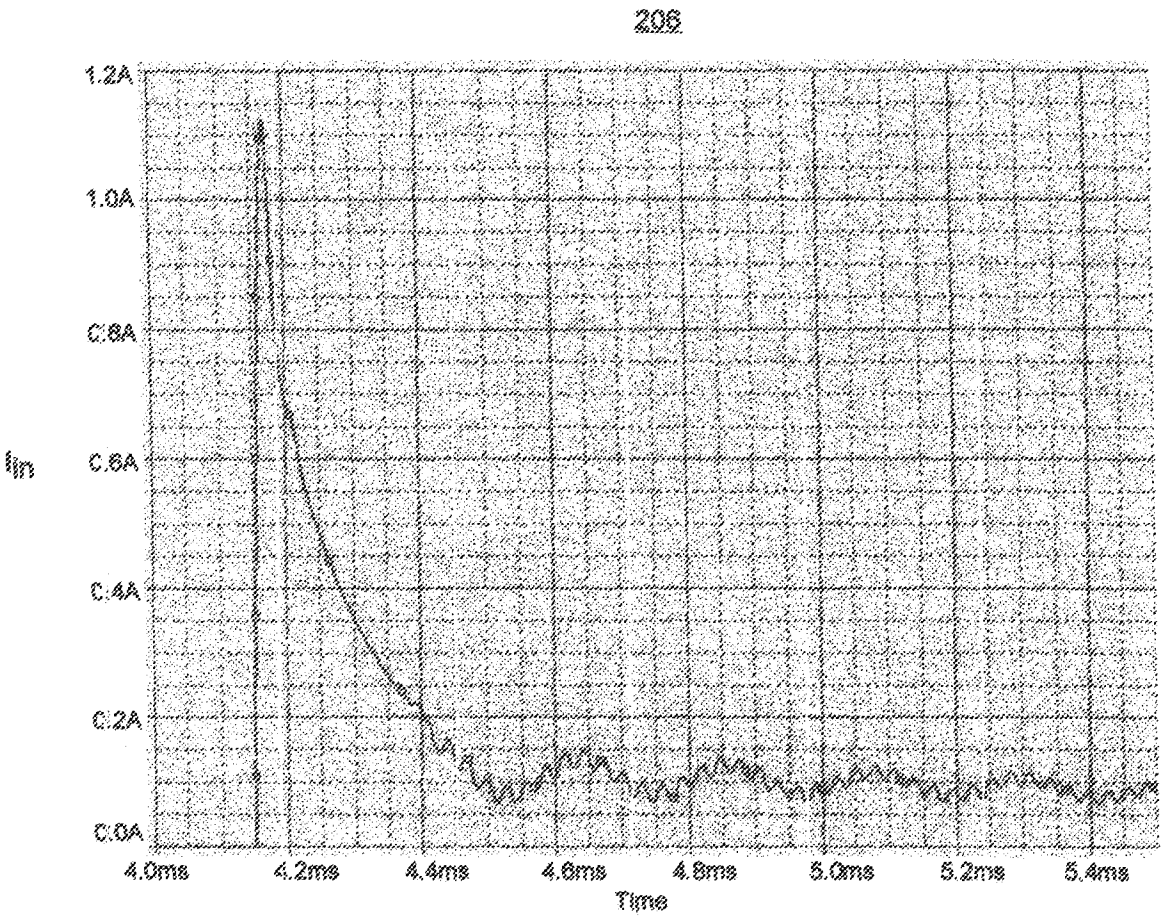
FIG. 2D shows a graph of simulation results for the active damping circuit of FIG. 1 when the input voltage is 277V at half load.

FIGS. 2A-2D show graphs of various simulation results for the active damping circuit of FIG. 1 with different inputs. FIG. 2A shows a graph 200 of simulation results of the input line current for the active damping circuit of FIG. 1 when the input voltage is 120V at half load. FIG. 2B shows a graph 202 of simulation results of the input line current for the active damping circuit of FIG. 1 when the input voltage is 120V at full load. FIG. 2C shows a graph 204 of simulation results of the input line current for the active damping circuit of FIG. 1 when the input voltage is 277V at full load. FIG. 2D shows a graph 206 of simulation results of the input line current for the active damping circuit of FIG. 1 when the input voltage is 277V at half load.

Figure 3A:
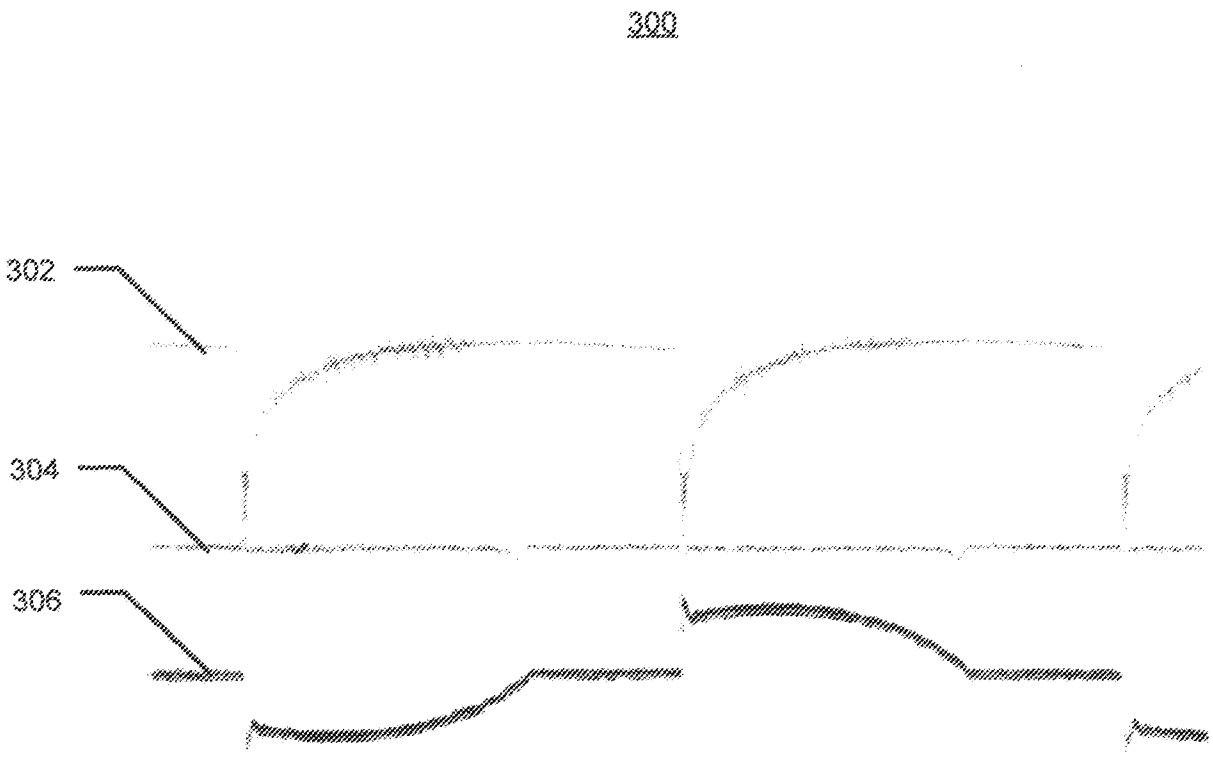
FIG. 3A shows a graph of a first set of test results of various values for a leading edge dimmer used with the active damping circuit of FIG. 1 when the input voltage is 277V at full load.

FIG. 3A shows a graph 300 of a first set of test results of various values for a leading edge dimmer used with the active damping circuit of FIG. 1. The gate-source voltage of the MOSFET Q1 of FIG. 1 is shown in line 302. The voltage across the resistor R1 by sensed current is shown as line 304. The input line current is shown as line 306.

Figure 3B:
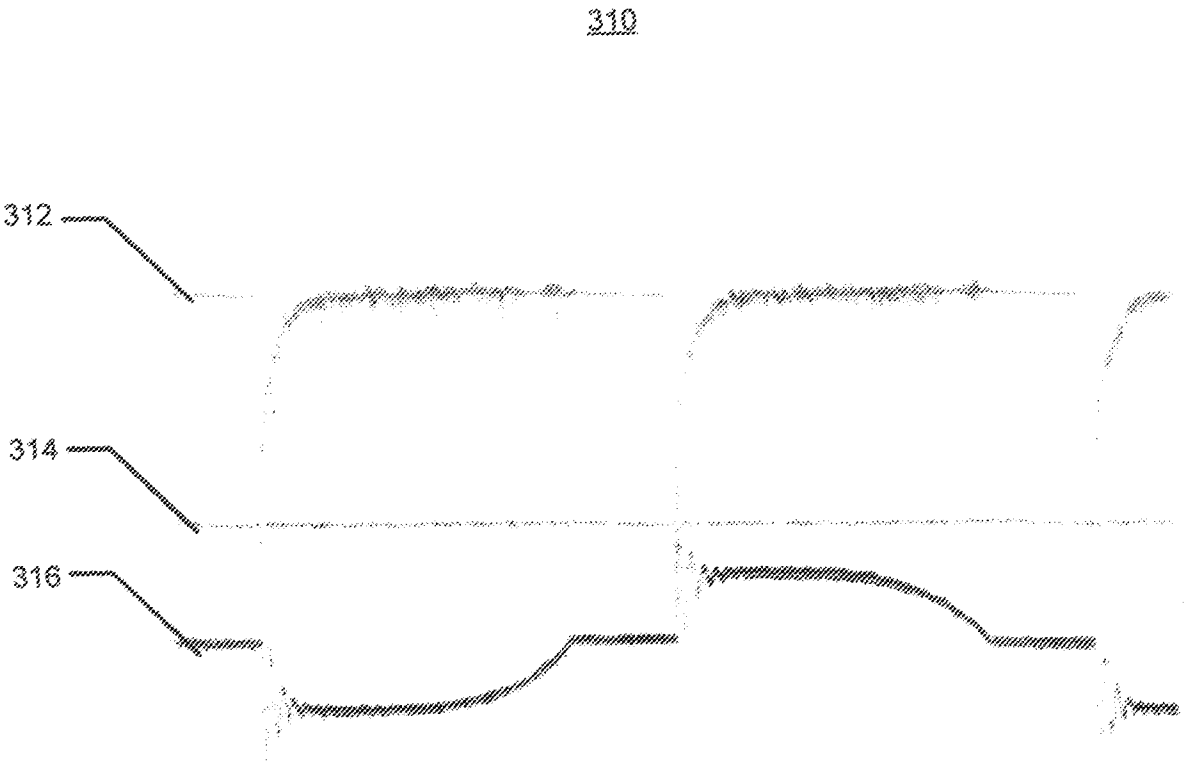
FIG. 3B shows a graph of a second set test results of various values for a leading edge dimmer used with the active damping circuit of FIG. 1 when the input voltage is 277V at half load.

FIG. 3B shows a graph 310 of a second set test results of various values for a leading edge dimmer used with the active damping circuit of FIG. 1. The gate-source voltage of the MOSFET Q1 of FIG. 1 is shown in line 312. The voltage across the resistor R1 by sensed current is shown as line 314. The input line current is shown as line 316.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer(s), workstation(s) (e.g., Sun, HP), personal digital assistant(s) (PDA(s)), handheld device(s) such as cellular telephone(s) or smart cellphone(s), laptop(s), handheld computer(s), or another device(s) capable of being integrated with a processor(s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. An active damping circuit, comprising:

a peak current limiter;

a drain source voltage limiter;

a turn-on driver;

a resistor shunt circuit; and a peak current sensor, wherein the peak current sensor comprises:

a first resistor comprising a first lead and a second lead, wherein the second lead is connected to a ground;

a first transistor comprising a gate, a source, and a drain, wherein the source is connected to the ground;

a first diode comprising a first lead connected to the gate of the first transistor, and a second lead connected to the first lead of the first resistor; and a first capacitor comprising a first lead connected to the gate of the first transistor and a second lead connected to the ground.

2. The active damping circuit of claim 1, wherein the peak current limiter comprises:

a second resistor comprising a first lead connected to the gate of the first transistor and the first lead of the first diode;

a third resistor comprising a first lead and a second lead, wherein the second lead is connected to the ground;

a fourth resistor comprising a first lead connected to the first lead of the first resistor and the second lead of the first diode; and a second transistor comprising a base, a collector, and an emitter, wherein the base is connected to the second lead of the third resistor, the collector is connected to the second lead of the second resistor, and the emitter is connected to the second lead of the fourth resistor.

3. The active damping circuit of claim 2, wherein the drain source voltage limiter comprises:

a second diode comprising a first lead and a second lead, wherein the first lead is connected to the drain of the first transistor; and a fifth resistor comprising a first lead and a second lead, wherein the first lead is connected to the first lead of the first diode, the first lead of the second resistor, and the gate of the first transistor, and wherein the second lead is connected to the second lead of the second diode.

4. The active damping circuit of claim 3, wherein the turn-on driver comprises:

a sixth resistor comprising a first lead and a second lead, wherein the first lead is connected to the first lead of the first diode, the first lead of the second resistor, and the gate of the first transistor; and a first voltage source comprising a first lead and a second lead, wherein the first lead is connected to the second lead of the sixth resistor and the second lead is connected to the ground.

5. The active damping circuit of claim 4, wherein the active damping circuit is configured to detect a rising edge of an input voltage from a phase cut dimmer via a rectifier by detecting a higher peak current flowing through the first resistor.

6. The active damping circuit of claim 5, wherein the higher peak current flowing through the first resistor results in a voltage drop across the first resistor, which through the third resistor drives a collector voltage of the second transistor low, which lowers a gate voltage of the first transistor, and forces the first transistor into a linear operating region, such that the first transistor functions as a damping resistor.

7. The active damping circuit of claim 6, wherein the first resistor and the fourth resistor are a gain for the turn-on driver, and wherein the second resistor limits a current of the second transistor.

8. The active damping circuit of claim 7, wherein the first resistor, the first capacitor, and the first transistor form a damper circuit configured to damp rings of an input current and to prevent input current ringing into the negative, which would turn off a phase cut dimmer connected to the active damping circuit.

9. The active damping circuit of claim 8, wherein a voltage at the drain of the first transistor is sensed, and feedback by the second diode and the fifth resistor limit the drain voltage of the first transistor.

10. The active damping circuit of claim 9, wherein the active damping circuit is configured to detect a passing of the turn-on edge of the input voltage such that a sensed peak current on the first resistor is decreased, and the second transistor returns to an off state, such that a voltage from the first voltage source recharges the gate of the first transistor, turning on the first transistor, such that the active damping circuit is waiting for a next edge of the input voltage.

11. The active damping circuit of claim 1, wherein the active damping circuit is configured to operate with an input voltage being between 120 volts and 277 volts, inclusive.

12. The active damping circuit of claim 1, wherein the active damping circuit is configured to detect a rising edge of an input voltage from a phase cut dimmer via a rectifier by detecting a higher peak current flowing through the peak current sensor.

13. The active damping circuit of claim 12, wherein the higher peak current flowing through the peak current sensor results in a voltage drop across a first resistor of the peak current sensor, which through a third resistor of the peak current limiter drives a collector voltage of a second transistor of the peak current limiter low, which lowers a gate voltage of a first transistor of the peak current sensor, and forces the first transistor into a linear operating region, such that the first transistor functions as a damping resistor.

14. The active damping circuit of claim 12, wherein the peak current sensor is configured to as a damper circuit configured to damp rings of an input current and to prevent input current ringing into the negative, which would turn off a phase cut dimmer connected to the active damping circuit.

15. The active damping circuit of claim 12, wherein a voltage at a drain of a first transistor of the peak current sensor is sensed, and feedback by the drain source voltage current limiter is configured to limit the voltage at the drain of the first transistor.

16. The active damping circuit of claim 12, wherein the active damping circuit is configured to detect a passing of the turn-on edge of the input voltage such that a sensed peak current at the peak current sensor is decreased, and a second transistor of the peak current limiter switches to an off state, such that a voltage from the turn on driver recharges a gate of a first transistor of the peak current sensor, turning on the first transistor, such that the active damping circuit is waiting for a next edge of the input voltage.

17. A system, comprising:

an input voltage source;

a phase cut dimmer;

a rectifier;

a filter circuit; and an active damping circuit, wherein the active damping circuit comprises:

a peak current limiter;

a drain source voltage limiter;

a turn-on driver;

a resistor shunt circuit; and a peak current sensor, wherein the peak current sensor comprises:

a first resistor comprising a first lead and a second lead, wherein the second lead is connected to a ground;

a first transistor comprising a gate, a source, and a drain, wherein the source is connected to the ground;

a first diode comprising a first lead connected to the gate of the first transistor, and a second lead connected to the first lead of the first resistor; and a first capacitor comprising a first lead connected to the gate of the first transistor and a second lead connected to the ground.

18. The system of claim 17, wherein the filter circuit comprises:

a second capacitor comprising a first lead connected to the drain of the first transistor and a second lead;

a first inductor comprising a first lead connected to the second lead of the second capacitor and a second lead configured to receive a rectified voltage from the rectifier;

a third diode comprising a first lead and a second lead, wherein the first lead is connected to the first lead of the first inductor; and a fourth diode comprising a first lead connected to the second lead of the third diode and a second lead connected to the second lead of the first inductor.

19. The system of claim 18, wherein the first resistor, the first capacitor, and the first transistor form a damper circuit that, in combination with the inductance of the filter circuit, damp rings of the input current and to prevent input current ringing into the negative, which would turn off the phase cut dimmer.

* * * * *